US007288035B2

(12) United States Patent
Young, Jr.

(10) Patent No.: US 7,288,035 B2
(45) Date of Patent: Oct. 30, 2007

(54) FLAG APPARATUS WITH ELECTRONIC SOUND GENERATING DEVICE FOR USE IN SPORTS AND GAMES

(76) Inventor: William H. Young, Jr., 1605 Heather Dr., Downingtown, PA (US) 19335

( * ) Notice: Subject to any disclaimer, the term of this patent is extended or adjusted under 35 U.S.C. 154(b) by 86 days.

(21) Appl. No.: 10/984,554

(22) Filed: Nov. 8, 2004

(65) Prior Publication Data

US 2005/0192127 A1 Sep. 1, 2005

Related U.S. Application Data

(60) Provisional application No. 60/517,678, filed on Nov. 7, 2003.

(51) Int. Cl.
*A63B 71/00* (2006.01)

(52) U.S. Cl. ..... 473/502

(58) Field of Classification Search ..... 473/502, 473/470, 473, 503; 84/718, 720; 24/307; 482/8, 3, 1; D21/788
See application file for complete search history.

(56) References Cited

U.S. PATENT DOCUMENTS 3,893,099 A * 7/1975 Zoepfl ..... 340/323 R
3,983,483 A * 9/1976 Pando ..... 455/90.2
4,121,488 A * 10/1978 Akiyama ..... 84/720
4,412,106 A * 10/1983 Pavel ..... 381/309
4,662,260 A * 5/1987 Rumsey ..... 84/653
4,957,231 A * 9/1990 Kalisher ..... 224/583
5,353,975 A * 10/1994 Libertucci ..... 224/681
5,381,922 A * 1/1995 Gladman et al. ..... 220/481
5,711,469 A * 1/1998 Gormley et al. ..... 224/675
5,742,939 A * 4/1998 Williams ..... 2/69
6,077,194 A * 6/2000 Chang ..... 482/8
2004/0220686 A1* 11/2004 Cass ..... 700/94

* cited by examiner

*Primary Examiner*—Eugene Kim
*Assistant Examiner*—M. Chambers

(57) ABSTRACT

The present invention is a flag or tail apparatus that incorporates an electronic sound generating device. In some embodiments of this invention, the flag or tail may be removably appended to a belt. Upon decoupling of the flag or tail in the normal course of play, the motion activated electronic sound generating device will emit a sound. The flag or tail can be used in games requiring a player to touch or capture the flag of another player. In the preferred embodiment, the exterior surface of the flag is distinctly modeled after the texture, pattern, and coloring of a specific wild animal's tail. In the preferred embodiment the emitted sound is consistent with the animal pattern displayed upon the flag.

13 Claims, 2 Drawing Sheets

FLAG APPARATUS WITH ELECTRONIC SOUND GENERATING DEVICE FOR USE IN SPORTS AND GAMES

Benefit of U.S. Provisional Patent Application No. 60/517,678 filed Nov. 7, 2003 is hereby claimed.

BACKGROUND OF THE INVENTION

1. Field of the Invention

This invention relates to novel removable flags capable of emitting a sound upon removal. These flags are commonly used in football and other tag related games. These sports and games, and the use of the present invention, may be practiced indoors, outdoors, in schools, parks or any other area appropriate for sports and games.

2. Description of Related Art

Many children's games require the tagging or touching of another player. As one way to reduce injuries from tagging or touching, "flag" systems have been developed in which flags are removably attached to players. The tagging player pulls the flag free from the tagged player. The capture of the flag not only prevents any unnecessary or unintentional harsh contact between players, but also serves as a veritable token of success of the tag. Examples of games utilizing such systems are tag and flag football.

One of the oldest flag systems in sports and games involves the use of a handkerchief tucked into the interior of some article of clothing with a majority of the handkerchief still visible and removable from the exterior. Such an early flag system is described by Roselle, U.S. Pat. No. 2,846,224. This method is still practiced today in situations where more elaborate flag systems are unavailable, unwanted or unanticipated. The handkerchief method presents some drawbacks. Firstly, the force which is needed to remove the flag can vary wildly, depending upon the relative tension on the flag is held between an individual's body and article of clothing. Due to the variance of the coupling tension, flags can potentially decouple prematurely or be unduly burdensome to decouple. The initial flag systems also often required a tagger to reach hazardously far into a player's personal space to remove the flag, thus creating the potential for injury.

Roselle, U.S. Pat. No. 2,846,224 teaches the use of a belt apparatus in combination with removable flags. Roselle states that the use of the belt allows for the creation of a uniform coupling tension. According to Roselle the use of a belt also allows the flags to be worn farther away from an individual's body, thus decreasing the potential for injury during play. The belt and flag system taught by Roselle does possess some drawbacks. For example, handkerchief flag systems are more economical and lightweight than the flag system taught by Roselle.

Abbott et al., U.S. Pat. No. 2,986,396 teach the use of inexpensive, lightweight and easily manufacturable materials, such as thermoplastics, to construct a belt and flag apparatus. Abbott et al. claim that such materials offer more flexibility and durability in a flag system. Abbott et al. further claim that the materials allow for the production of flags in bright, distinctive colors which further assist in the differentiation and recognition of teams. The belt and flag system taught by Abbot et al. also has some drawbacks. Due to the fact that Abbott et al. teach the use of a thermoplastic snap as a coupling and decoupling means, the flag may be unduly burdensome to couple and decouple because of the increased tension in comparison to earlier handkerchief flag systems.

Wilson, U.S. Pat. Nos. 3,251,109 and 3,345,070 teaches the use of a mechanism for snap on coupling which allows for the varying of coupling tension via a means of an adjustable screw. Wilson teaches that this allows for easier coupling and decoupling than is taught by Roselle and Abbott. Wilson also claims that this mechanism allows for coupling tension to be varied depending on the preferences of the individual. The flag systems as taught by Wilson 109 and 070 also have some drawbacks. The coupling mechanisms contain a comparatively large number of parts as compared to handkerchief systems.

Steinkamp, U.S. Pat. No. 3,063,718 and Batton, U.S Pat. No. 5,451,046 teach the use of hook and loop fastening materials as a means for coupling and decoupling the flag. Steinkamp and Batton claim that the use of hook and loop fastening materials allow for coupling and decoupling as easy and simply as that taught by handkerchief flag systems, but also allows for the use of belts similar to those used in Roselle, Abbott and Wilson, ('109 and '070.) The use of hook and loop fastening materials also accomplishes coupling and decoupling with fewer moving parts than that required by the mechanisms disclosed in Roselle, Abbott and Wilson, ('109 and '070.) It is also taught that the use of the hook and loop materials provide a distinctive ripping sound upon decoupling, and thus gives some notice that the flag has been removed. Belt and flag systems containing hook and loop coupling and decoupling mechanisms also have drawbacks. An example of such a drawback is the fact that the tearing sound created upon decoupling of the hook and loop material is not necessarily sufficiently loud and distinctive so as to guarantee audibility and recognition over the din of noises created during the normal course of play.

Wilson, U.S. Pat. Nos. 4,651,989 and 6,241,631 teaches the use of a particular coupling mechanism which creates a distinctive "pop" noise upon detachment of the flag from the belt apparatus, thus giving some notice that the flag has been removed. This mechanism also has disadvantages. One such disadvantage is the fact that Wilson ('989 and '631) returns to a more complex design which Steinkamp and Batton sought to replace.

BRIEF SUMMARY OF INVENTION

The invention comprises a flag apparatus. The flags are formed from a tubular length of flexible material, which is sufficiently lightweight so as to allow free movement while attached to an individual. The length of material is sufficiently long so as to permit grasping and removal, but not so long as to create a hazard to the wearer. The flag may have a means for coupling and decoupling itself from an individual.

The flag apparatus also incorporates a sound generating device which provides distinctive and audible sound upon decoupling of the flag from an individual, or upon sharp movement. The electronic sound generating device may be contained on or within the flag.

The invention may also incorporate a belt. The belt is comprised from a flexible piece of material with an exterior surface, interior surface, a first end and a second end. The belt has situated upon its exterior surface a means for coupling and decoupling flags. The belt also has a means for fastening itself comfortably around an individual's waist.

DETAILED DESCRIPTION OF THE INVENTION AND PREFERRED EMBODIMENT

Figure 1:
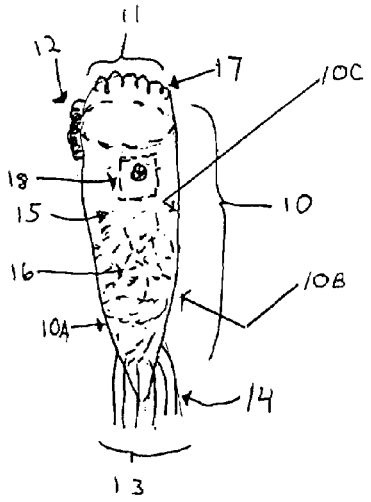
FIG. 1 is a diagrammatic side elevational view of the flag according to the preferred embodiment of the invention with the exterior surface of the flag rendered in solid lines and the contents of the interior cavity rendered in phantom lines.

In FIG. 1, flag 10 for use in a flag system is pictured. Flag 10 is formed from a tube of flexible material 10A having an exterior surface 10B, an interior surface 10C, a top end 11 and a bottom end 13. The material 10A is sufficiently lightweight so as to allow free movement while flag 10 is coupled to an individual. In the preferred embodiment the exterior surface 10B will possess a pattern and color consistent with that of a wild animal. Examples of such patterns include but are not limited to tigers, lions, elephants, zebras, wildebeests and so on. In the preferred embodiment, this flexible material is a plush fabric common to that used in the construction of "stuffed animals." In some embodiments of this invention, the bottom area 13 may possess tassels 14 which are consistent with the hair found on the base of the tail of certain wild animals. The use of a wild animal pattern, in conjunction with a plush material which simulates the look and feel of wild animal's pelts creates an appeal for the invention amongst children and young adults. In addition, wild animal patterns are often sufficiently distinctive so as to allow the easy formation and differentiation of teams. Further, the use of wild animal patterns can allow for a hierarchy of chase and capture games, with "lions" chasing "zebras" and so on. Although the preferred embodiment is directed to a flag 10 whose pattern, color and texture of the exterior surface 10B are consistent with that of a wild animal, this invention also encompasses a flag 10 which has a pattern, color and texture of the exterior surface 10B other than that of a wild animal.

In the preferred embodiment the exterior surface 10B of the top area 11 has fixedly attached an effective amount of a loop portion 12 of a hook and loop fastening material sufficient to removably couple flag 10 with a hook fastener surface. Although the preferred embodiment of this invention is directed to the use of a loop and hook fastener material as a means for coupling and decoupling flag 10, other coupling and decoupling means well known in the art may be used. For example, where a coupling means capable of varying the coupling tension is desired, a coupling mechanism similar to that used in Wilson (109 and 070) may be used.

Flag 10 also has an interior cavity 15 which is defined by the interior surface 10C of the tube of flexible material 10A. The interior cavity may be substantially empty or substantially filled. If the cavity is substantially filled, it may be filled by stuffing 16 commonly used to fill "stuffed animals." In some embodiments of this invention, the top area 13 of flag 10 may contain an opening 17 through which materials may be inserted into or removed from the interior cavity of flag 10. This opening may be stitched closed with thread or coupled closed via hook and loop fastener material or other means well known in the art.

Figure 2:
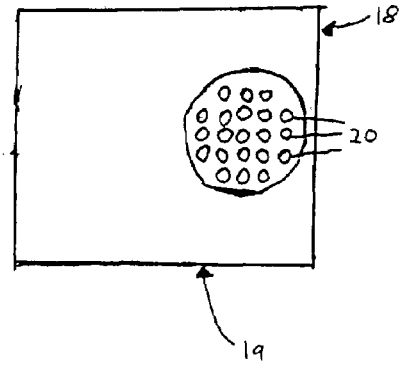
FIG. 2 is a side view of the exterior housing of the electronic sound generating device.

In FIG. 2, the exterior casing 19 of an electronic sound generating device 18 is pictured. A plurality of apertures 20 are located on the exterior casing 19. The electronic sound generating device 18 is contained within the interior cavity 15 of flag 10. In the preferred embodiment the electronic sound generating device 18 is positioned in the interior cavity 15 of flag 10 at or near the top end 11. In alternate embodiments the sound generating device may be located on the surface of the flag 10 or exterior to and separate from the flag entirely.

Figure 3:
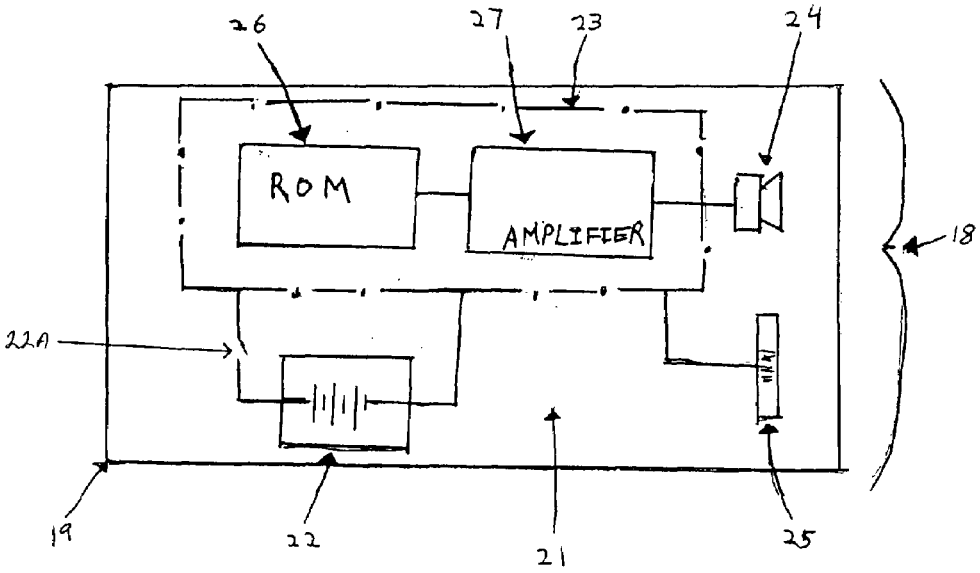
FIG. 3 is a side view of the components contained within the interior compartment of the electronic sound generating device with the edges of an integrated circuit chip rendered in phantom lines.

The electronic sound generating device 18 also has an interior compartment 21, the contents of which are pictured in FIG. 3. In some embodiments of this invention, the interior compartment 21 may be accessed from the exterior casing 19 via a means of a hatch or similar mechanism well known in the art. Such a hatch or other means would allow various components of the sound generating device 18 to be removed or replaced. The interior compartment 21 contains a battery 22, an integrated circuit chip 23, a speaker 24 located below the plurality of apertures 20, and a motion detection device 25, all operatively connected. The battery 22 may be permanently fixed within the interior compartment or may be removable. In some embodiments, there may be an on/off switch 22A which may used to engage and disengage the battery 22. In other embodiments of this invention this on/off switch 22A may be in the form of a micro-switch. This micro-switch would be situated so as to disengage the battery while the flag is in a coupled state, and engage the battery when the flag is in an uncoupled state. The integrated circuit chip 23 contains a ROM memory chip 26 and an amplifier 27. The ROM memory chip 26 has a digitally encoded sound. In the preferred embodiment, the ROM memory chip 26 is encoded with a sound that is consistent with the animal pattern visible on the exterior surface 10. For example, if the exterior surface 10B has a pattern and coloring consistent with that found on a lion, then the ROM memory chip 26 would be encoded with a lion's roar. If the exterior surface 10B of flag 10 is not consistent with the pattern, color or texture of any wild animal, then the ROM memory chip 26 may be encoded with some other sound. An example of such a sound is a recording of a human voice saying "Got you." or "Tag, you're it!" Yet other embodiments of this invention allow for multiple sounds to be produced by a single sound generating device. Such multiple sounds may be either randomly or non-randomly generated via means well known in the art. An example of non-random sound generation would be a human voice saying "Got you" and thereafter saying "Got you again."

Figure 4:
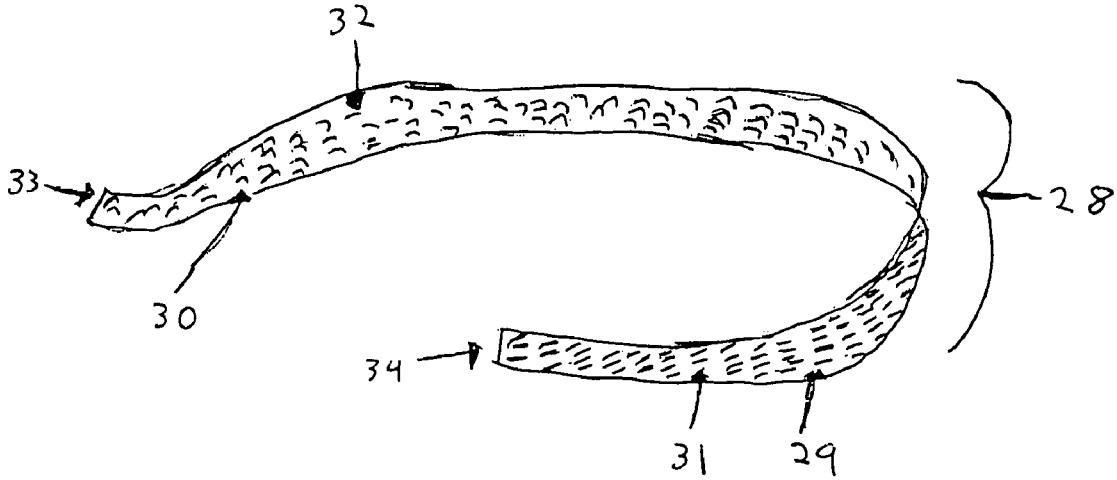
FIG. 4 is a perspective side view of the belt in accordance with the preferred embodiment of this invention shown in an unfastened condition.

In FIG. 4 a belt 28 is displayed. The belt 28 has and exterior surface 29 interior surface 30, a first end 33 and a second end 34. The exterior surface 29 of the belt 28 contains a means for coupling and decoupling flag 10. In the preferred embodiment this means is a hook portion 31 of an amount of a hook and loop fastener material. In the preferred embodiment, the hook fastener material 31 encompasses the entire surface area of the exterior surface 30 of the belt 28. This allows for a maximum variation in arrangement of flags 10 upon the belt 28. In the preferred embodiment the interior surface 30 has a loop portion 32 of a hook and loop fastener material, which covers the entire surface area of the interior surface 30. The use of loop material 32 on the interior surface 30 allows for added comfort when worn about an individual's waist. At or near the first end 33 and the second end 34 is a means for comfortably fastening the belt about an individual's waist. In the preferred embodiment this fastening means is hook fastener material 31 found on the exterior surface 29 coupled with the loop fastener material 32 found on the interior surface 30.

In the course of a game of tag where the preferred embodiment of this invention is utilized, a player fastens the belt 28 around his or her waist. One or several flags are then coupled to the exterior surface 29 via the hook fastener material 31 and the loop fastener material 12. When a flag is pulled with sufficient force to uncouple the loop fastener material 12 from the hook fastener material 31 the motion detection device 25 is triggered. In the preferred embodiment the motion diction device 25 should be constructed so as to activate only upon decoupling, rather than upon the jostling and bouncing normal to play. The motion detection device then sends a signal to the ROM memory chip 26. The ROM memory chip 26 in turn sends a signal of its encoded sound information to the amplifier 27. The amplifier 27 increases the signal strength and directs it to the speaker 21. The speaker 24 produces the sound encoded on the ROM memory chip 26, and the sound is audible through the plurality of apertures 20.

Though some embodiments of this invention are directed to the use of the flag 10 in conjunction with a belt, other embodiments of this invention encompass the use of the flag 10 alone. In such embodiments, the flag may, for instance, be used as a prop in an interactive story. Where indicated in the text of the story the participants/listeners may manipulate the flags as directed including tapping or otherwise handling the flags so as to activate and produce the desired sound.

I claim:

1. A children's tag game flag and belt apparatus comprising:

a) a flag sufficiently flexible and long so as to permit grasping and removal;

b) a belt;

c) a means for coupling and decoupling the flag and the belt; and d) an electronic sound generating device contained within the interior cavity of the flag comprising:

i) an external casing;

ii) a plurality of apertures located on said exterior casing;

iii) an interior compartment; a battery located within said interior compartment;

iv) an integrated circuit chip located within said interior compartment and connected to v) said battery further comprising:

1) a ROM memory chip containing a digitally encoded sound; and 2) an amplifier connected to said ROM memory chip;

vi) a motion detection device within said interior compartment connected to said integrated circuit chip; and vii) a speaker located within said interior compartment connected to said amplifier and positioned in proximity to said plurality of apertures wherein the motion of the removal of the flag from the belt triggers the sound generating device to emit a sound.

2. A children's tag game flag and belt apparatus:

a) a flag comprising:

i) a tubular length of flexible material sufficiently long so as to permit grasping and removal comprising:

1) an exterior surface;

2) an interior surface 3) an interior cavity defined by said interior surface;

4) a top end;

5) a bottom end;

b) a belt comprising:

i) a length of flexible material of sufficient length to comfortably encircle an individual's waist, said length comprising:

1) a first end;

2) a second end;

3) an exterior surface;

4) an interior surface; and ii) a means for fastening said first end and said second end of said length so as to fit comfortably around said individual's waist;

c) a means for coupling and decoupling said flag from said belt and d) an electronic sound generating device comprising i) an external casing;

ii) a plurality of apertures located on said exterior casing;

iii) an interior compartment;

iv) a battery located within said interior compartment;

v) an integrated circuit chip located within said interior compartment and connected to said battery further comprising:

1) a ROM memory chip containing a digitally encoded sound; and 2) an amplifier connected to said ROM memory chip;

vi) a motion detection device within said interior compartment connected to said integrated circuit chip; and vii) a speaker located within said interior compartment connected to said amplifier and positioned in proximity to said plurality of apertures wherein the motion of the removal of the flag from the belt triggers the sound generating device to emit a sound.

3. The flag and belt apparatus of claim 2 wherein the electronic sound generating device is located within the internal cavity of said flag.

4. The flag and belt apparatus of claim 3 wherein the sound generating device further comprises an on/off switch capable of engaging and disengaging said battery.

5. The flag and belt apparatus of claim 2 wherein the electronic sound generating device is located on the exterior surface of said belt.

6. The flag and belt apparatus of claim 2 wherein the means for fastening said first and second end of said belt further comprises:

a hook fastener material covering substantially all of said exterior surface used in conjunction with a loop fastener material covering substantially all of said interior surface.

7. The belt and flag apparatus with electronic sound generating device of claim 2 wherein the means for coupling and decoupling said flag from said outward facing exterior surface of said belt further comprises:

an effective amount of a loop fastener material located on said exterior surface of said flexible material of said flag used in conjunction with said hook fastener material on said exterior surface of said belt.

8. The flag and belt apparatus of claim 2 wherein said flexible material has a pattern, texture, and coloring consistent with the pattern, texture and coloring of the skin of a wild animal.

9. The flag and belt apparatus of claim 2 wherein the ROM memory chip contains the sound commonly made by a wild animal.

10. The flag and belt apparatus of claim 2 wherein the ROM memory chip contains a sound of a human voice speaking.

11. The flag and belt apparatus of claim 10 wherein the on/off switch is a micro switch which is engaged when the belt is in a coupled state and disengaged when the belt is in an uncoupled state.

12. The flag and belt apparatus of claim 2 wherein the sound generating device further comprises an on/off switch capable of engaging and disengaging said battery.

13. The flag and belt apparatus of claim 8 wherein the on/off switch is a micro switch which is engaged when the belt is in a coupled state and disengaged when the belt is in an uncoupled state.

* * * * *